US005815960A

United States Patent [19]

Soczka

[11] Patent Number: 5,815,960

[45] Date of Patent: Oct. 6, 1998

[54] RETARDING MECHANISM FOR THE DIPPER DOOR OF A MINING SHOVEL

[75] Inventor: Carl A. Soczka, Milwaukee, Wis.

[73] Assignee: Harnischfeger Corporation, Milwaukee, Wis.

[21] Appl. No.: 874,434

[22] Filed: Jun. 16, 1997

[51] Int. Cl.[6] ..... E02F 3/407

[52] U.S. Cl. ..... 37/445; 37/444; 414/726; 16/86 B; 267/154

[58] Field of Search ..... 37/445, 444, 443, 37/403; 414/726; 16/375, 86 R, 86 A, 86 C, 86 B; 267/279, 154

[56] References Cited

U.S. PATENT DOCUMENTS

| | | | |
|---|---|---|---|
| 2,434,902 | 1/1948 | Burdick | 414/726 |
| 2,735,559 | 2/1956 | Burdick et al. | 37/444 |
| 2,840,253 | 6/1958 | Thompson | 37/444 |
| 4,006,832 | 2/1977 | Auxer et al. | 37/445 X |
| 5,613,308 | 3/1997 | Little | 37/445 |

FOREIGN PATENT DOCUMENTS

| | | | |
|---|---|---|---|
| 607893 | 5/1978 | Russian Federation | 37/445 |
| 713949 | 2/1980 | Russian Federation | 37/445 |
| 914727 | 3/1982 | Russian Federation | 37/445 |

*Primary Examiner*—Tamara L. Graysay
*Assistant Examiner*—Thomas A. Beach
*Attorney, Agent, or Firm*—Larry Shupe

[57] ABSTRACT

Disclosed is a digging implement such as a mining shovel dipper which has a body, a movable door mounted with respect to the body and a mechanism for retarding swinging movement of the door. The mechanism includes first and second housings and plural retarding discs compressed between the housings. In the improvement, a resilient member is interposed between the first housing and the discs. And most preferably, a separate resilient member is interposed between each housing, respectively, and the discs. The thickness of each resilient member is selected in view of the aggregate thickness of the discs and the number of resilient members if more than one such member is used. A highly preferred resilient member is an elastomeric washer. The new retarding mechanism substantially extends the time period between mechanism adjustments and results in improved machine productivity.

13 Claims, 5 Drawing Sheets

RETARDING MECHANISM FOR THE DIPPER DOOR OF A MINING SHOVEL

FIELD OF THE INVENTION

This invention relates generally to excavating and, more particularly, to open-pit mining shovels having scoop-like "dippers."

BACKGROUND OF THE INVENTION

Mining shovels are in wide use and have particular utility in open pit mining where the material being mined, often a mineral such as coal or ore, is at or relatively close to the earth's surface. Electrically-powered shovels are particularly popular and a leading manufacturer of mining shovels, including electric shovels, is Harnischfeger Corporation, Milwaukee, Wis.

A mining shovel has a machinery housing and operator's cab mounted on a chassis supported by a pair of crawler tracks. Extending from the housing is a boom having a pivot-mounted handle with a shovel (or "dipper") at the handle end. The dipper, a special type of container, has a hollow, generally rectangular body, forward-facing digging teeth mounted on the body and a latching door pivot-mounted at the rear of the body for closing the opening in the bottom of such body.

After the dipper is loaded with material, such dipper is raised and the housing is pivoted on the chassis until the dipper is over, e.g, a waiting truck. The door is unlatched and swings downwardly under force of gravity, permitting the material to fall from the dipper into the truck. The quantity of material per digging cycle is very substantial; a dipper having a capacity of 40 cubic yards will drop about 120,000 pounds of material (computed at 3000 pounds per cubic yard) into the truck on each cycle. And dippers having a 60 cubic yard capacity are in use.

After emptying the dipper, the boom is moved to an angle such that the dipper faces downwardly in a direction to dig again. When the dipper is so oriented, the door swings shut under force of gravity and again latches.

A dipper door which is permitted to swing unretarded is undesirable for a number of reasons. If the boom is moved to an angle such that the dipper is between the crawler tracks for a new "dig," the dipper is sharply tilted and an unretarded or inadequately-retarded door clangs hard against the dipper body. At the least, the sound is annoying and considering that the door on a large dipper may weigh in excess of 40,000 pounds (more than 18,000 kilograms) such sound may be deafening to the shovel operator and audible to others some distance away.

And noise is not the only problem with a dipper door, the pivoting movement of which is unretarded or inadequately-retarded. When the dipper is loaded, the door supports substantially the entire weight of the material in the dipper and "dishes" or bows outwardly slightly. While dipper doors are designed to withstand such mechanical stresses, they are less able to withstand the stress of a door impacting the dipper body as the door clangs shut. Such impact tends to bow the door inwardly and cracks or outright fractures in the door may develop. In fact, an inadequately-retarded dipper door may be ruined in 2–3 weeks of hard mining service.

And door damage is not the only problem arising from door pivoting movement which is unretarded or inadequately-retarded. As material is emptied from the dipper, the door may slam against the side of the truck and cause damage, perhaps severe damage.

A good deal of design effort has been directed toward configuring a satisfactory mechanism for retarding swinging, pivoting movement of the door of a dipper. A popular arrangement uses interleaved plates (which move relative to one another) and brake-like retarding discs between the plates. The plates and discs are clamped together by and between housings having a bolt through the plates, discs and housings. The bolt is tightened to to obtain the right degree of retardation without preventing the door from opening or closing smoothly. While this arrangement works well after initial adjustment, disc wear causes the clamping force to diminish to a level that door retardation is inadequate. With new discs, this deterioration in retardation may occur in hours or, at most, a day.

A known modification of the aforedescribed basic arrangement uses a large spring or stacks of Belleville washers between each of the bolt head and nut ends, respectively, and the clamping housing adjacent thereto. Improved performance results. But even with such improvement, the bolt must be incrementally tightened after one day, three days, 7 days and about 90 days of operation after new discs are installed. (The reason for the lengthened intervals between tightening is that new discs wear more rapidly at the onset of use as they "seat" to the contacted plate surface.)

Of course, time spent in adjusting the retardation rate of the dipper door represents lost production time. Another reason, now quite apparent, why proper dipper door retardation is important relates to equipment breakage. A dipper door fractured by repeated, severe impact with the dipper body may involve an expenditure of upward of $130,000–$140,000 in replacement cost of the door alone. And in the case of a mining shovel costing several million dollars, the "downtime" resulting from repeated mechanism adjustment and/or the need to replace prematurely-failed parts is enormously expensive in terms of return on the investment.

And the investments in the shovel and in a replacement dipper door are not the only financial parameters impacting return on investment. A single truck loaded by a shovel may cost over one million dollars and it is not unusual to have 3 to 5 trucks "dedicated" to hauling material removed by a single shovel. If the shovel is not working, the trucks also incur expensive downtime.

An improved retarding mechanism and related mining shovel dipper which addresses shortcomings of the prior art would be an important technical advance.

OBJECTS OF THE INVENTION

It is an object of the invention to provide an improved retarding mechanism for the door of a mining shovel dipper that overcomes some of the problems and shortcomings of the prior art.

Another object of the invention is to provide an improved retarding mechanism which reduces the incidence of impact-related fractures of dipper doors.

Another object of the invention is to provide an improved retarding mechanism which diminishes the frequency of mechanism adjustment.

Yet another object of the invention is to provide an improved retarding mechanism which helps reduce downtime of dipper-equipped mining shovels.

Another object of the invention is to provide an improved retarding mechanism which prolongs the life of mining shovel dipper doors.

Another object of the invention is to provide an improved dipper door retarding mechanism which helps maintain productivity.

Another object of the invention is to provide an improved dipper door retarding mechanism which helps avoid damage to truck receiving material from a dipper.

Still another object of the invention is to provide an improved retarding mechanism which helps reduce ambient noise. How these and other objects are accomplished will become apparent from the following descriptions and from the drawings.

SUMMARY OF THE INVENTION

The invention involves a digging implement such as a mining shovel dipper of the type having a body, a movable door mounted with respect to the body and a mechanism for retarding movement of the door. The mechanism includes first and second housings and plural retarding discs compressed between the housings. The improvement comprises a first resilient member interposed between the first housing and the discs. The mechanism includes a pivot axis and a bolt coincident with such axis and the annular ring is radially outwardly spaced well away from the bolt and from the pivot axis. Most preferably, such member includes an annular ring made of elastomeric material such as polyurethane.

The discs have an aggregate thickness and in a highly preferred embodiment, the resilient member has a free thickness which is greater than the aggregate thickness of the discs. When the mechanism is so configured, the discs can become very thin through wear and yet the resilient member maintains compressive force on such discs for retardation.

The new mechanism is not limited to a single resilient member. In another aspect of the invention, the implement further includes a second resilient member interposed between the second housing and the discs. Such second member also includes an annular ring of elastomeric material. Where two resilient members are used, one on each side of the discs, each resilient member preferably has a free thickness greater than one-half the aggregate thickness of the discs. Or the resilient members may be configured to have an aggregate free thickness greater than the aggregate thickness of the discs even though one such member has a free thickness less than the aggregate thickness of the discs.

In a more specific aspect of the invention, the dipper door has a plurality of arms, e.g., first and second arms, extending in a first direction from a pivot axis. In a specific type of dipper, such arms attach to a door support rib.

A plurality of plates extends in a second direction from the pivot axis and in the same, specific type of dipper, such plates attach to the body of the dipper. The arms, plates and retarding discs are interleaved or, as to the arms and plates, "interdigitated" and each plate is between a separate pair of arms. Further, a separate annular, flat retarding disc is between each plate and each arm and the discs are concentric with the pivot axis of the retarding mechanism.

First and second outwardly-positioned housings compress the arms, the plates and the discs. Compression is by a rod-type bolt which is coincident with the pivot axis and which has a nut on either end which may be tightened or loosened to adjust the degree of compression. In one embodiment having two (i.e., first and second) resilient members, such members are compressed between the first and second housings, respectively, and a respective arm (i.e., the first and second arms) immediately adjacent to each of such housings.

In another exemplary embodiment, the mechanism has first, second and third resilient members compressed between the housings. The first and second resilient members are between the first housing and the first arm and the third resilient member is between the second housing and the second arm.

In yet another exemplary embodiment, a first plurality of resilient members (i.e., two or more members) is compressed between the first housing and the discs. Similarly, a second plurality of resilient members (two or more members) is compressed between the second housing and the discs.

It is to be appreciated that these are only a few of the arrangements which are contemplated by the invention. The mechanism need not have the same number of resilient members on each side nor must the members have the same thickness. However, it is preferred that no matter how many resilient members are used, its free thickness or their aggregate free thickness should exceed the aggregate thickness of the discs. (As used in this specification, the term "free thickness" means the thickness measured in a direction parallel to the pivot axis when no compressive force is applied to a member or to the members.)

Further details of the invention are set forth in the following detailed description and in the drawings.

DETAILED DESCRIPTION OF PREFERRED EMBODIMENTS

Figure 1:
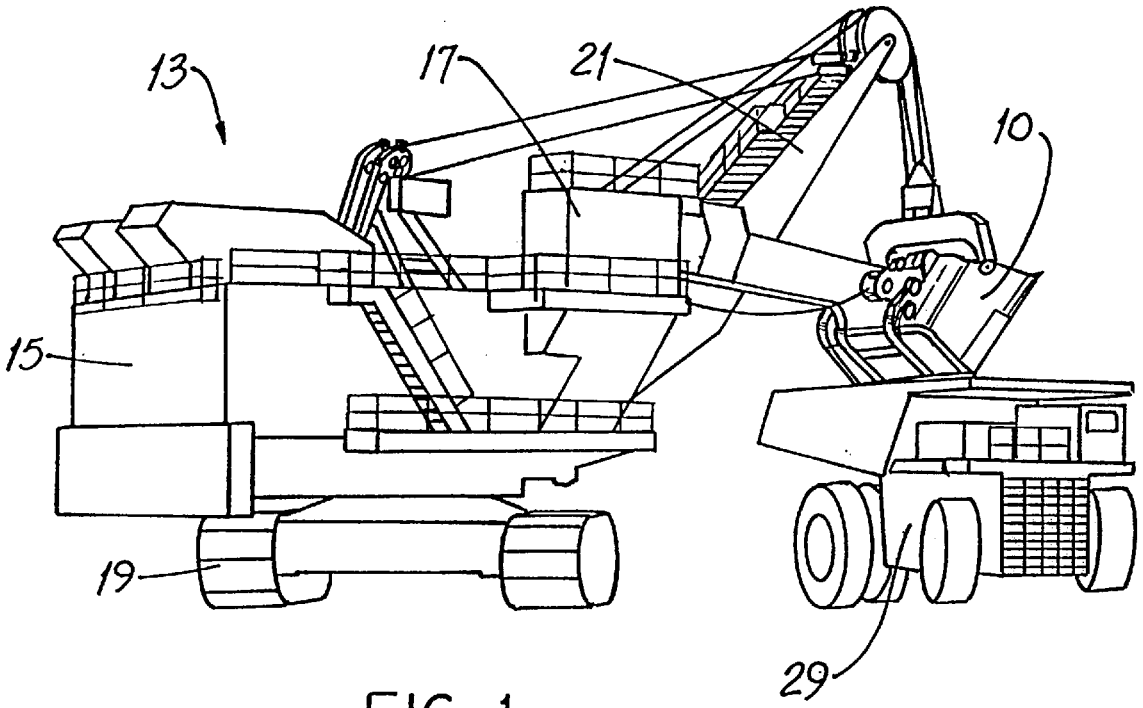
FIG. 1 is a representative perspective view of a mining shovel loading a truck using the shovel dipper.
Figure 2:
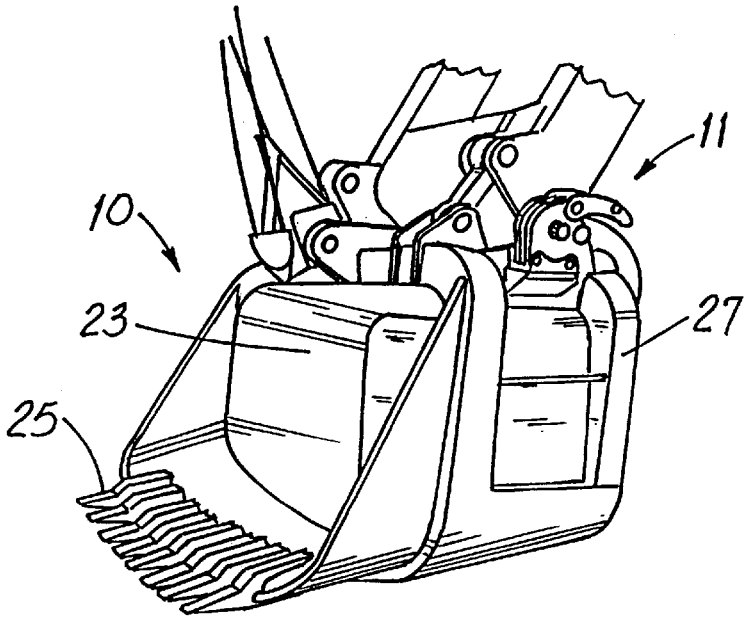
FIG. 2 is a representative perspective view of a dipper for a mining shovel.
Figure 3:
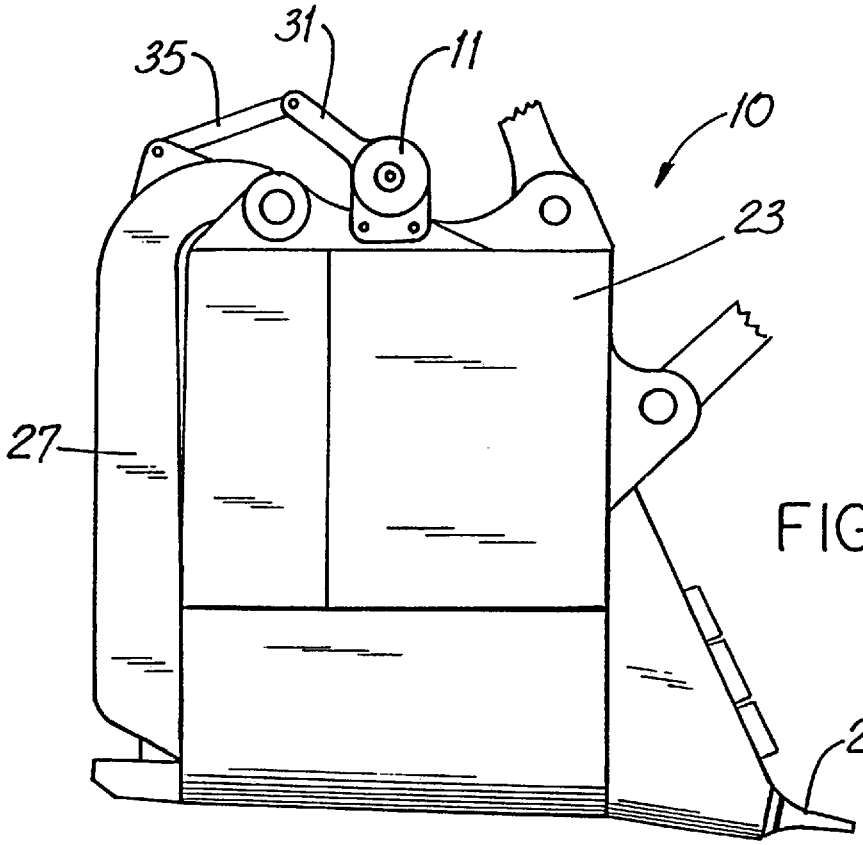
FIG. 3 is a side elevation view of a slightly different type of dipper for a mining shovel.

Before describing the new shovel dipper 10 and its retarding mechanism 11, it will be helpful to have an understanding of how such dipper 10 is used and how the mechanism 11 provides an important function. Referring to FIGS. 1 and 2, a mining shovel 13 has a machinery housing 15 and operator's cab 17 mounted on a chassis supported by a pair of crawler tracks 19. Extending from the housing 15 is a boom 21 with a handle having a dipper 10 at the handle end. The dipper 10 has a hollow, generally rectangular body 23, forward-facing digging teeth 25 mounted on the body 23 and a latching door 27 pivot-mounted at the rear of the body 23 for closing the opening in the bottom of such body 23.

When the dipper 10 is removing material from the earth, the door 27 is latched closed. And to load material into the truck 29, the latch is released and the door 27 swings downwardly under force of gravity. As the dipper 10 is again being positioned to dig, the door 27 swings shut and latches. Irrespective of the direction of door swing, the mechanism 11 retards door movement.

As shown in FIGS. 3 through 8, the mechanism 11 includes a plurality of spaced-apart arms 31 (including first and second arms 31*a* and 31*d*, respectively which extend away from the pivot axis 33 and attach to a group of links 35. In a specific dipper 10, such links 35 are coupled to a door-reinforcing rib (not shown).

Figure 8:
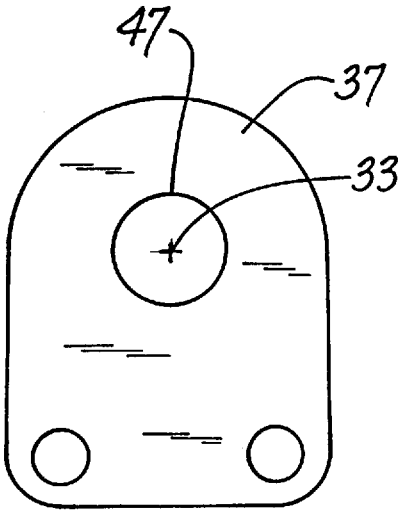
FIG. 8 is a side elevation view of a plate, another component of the retarding mechanism of FIGS. 5 and 6.
Figure 7:
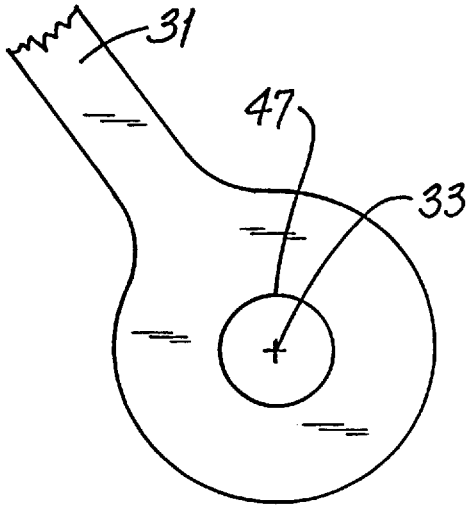
FIG. 7 is a side elevation view of an arm, a component of the retarding mechanism of FIGS. 5 and 6. Part is broken away.
Figure 4:
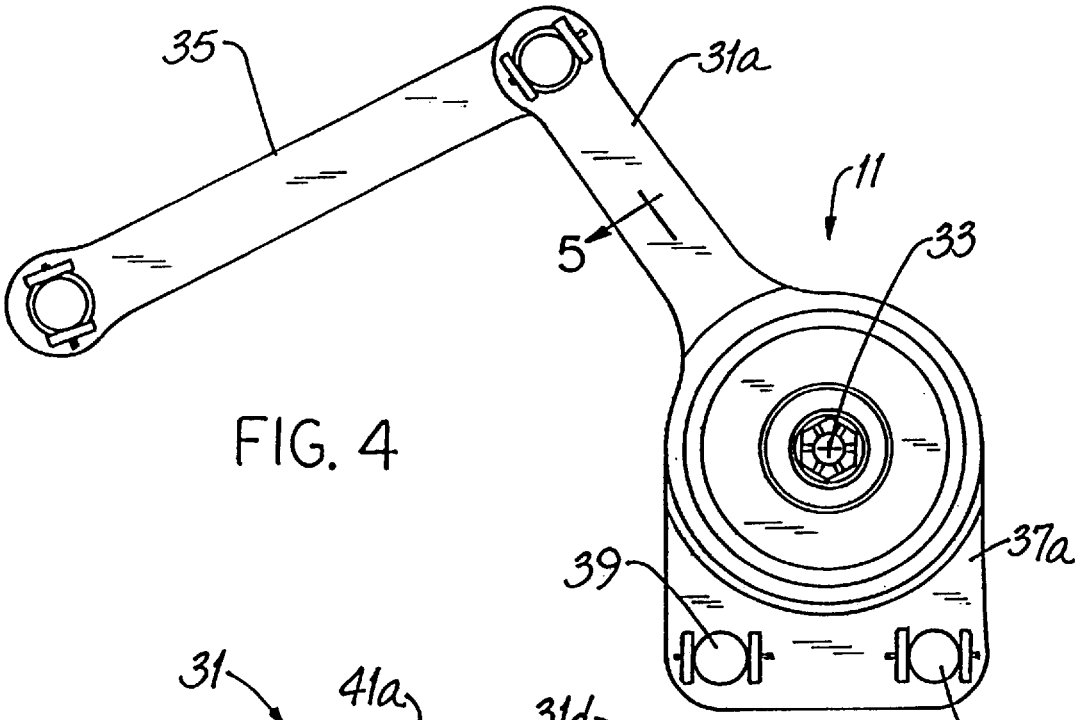
FIG. 4 is a side elevation view of the new retarding mechanism used with the dippers of FIGS. 2 and 3 and shown with an associated link.

The mechanism 11 also includes a plurality of spaced-apart plates 37*a*, 37*b*, 37*c* which are rigidly attached to the dipper body 23 by coupling pins or the like. An arm 31 is shown in FIG. 7 and a plate 37 is shown in FIG. 8.

Interposed between each arm 31 and its closely-adjacent plate 37 is a flat, annular retarding disc 41. The arms 31, plates 37 and retarding discs 41 are interleaved in that, as viewed from left to right in FIGS. 5 and 6, the components are arranged arm 31, disc 41, plate 37, disc 41, arm 31, and so forth.

The arms 31 and plates 37 and discs 41 are supported by a generally cylindrical bushing 43 open at both ends. The openings 47 through the arms 31, plates 37 and discs 41 are sized to slide over such bushing 43 with slight clearance.

The first and second housings 49 and 51, respectively, each include a boss 53 which is received in the bushing 43 with sliding clearance. Each housing 49, 51 has a central aperture 55 therethrough and a rod-type bolt 57 (so named because it is threaded at both ends) is received through the apertures 55, the arms 31, the plates 37 and the discs 41. The bolt 57 has a nut 59 on each end which may be tightened or loosened with respect to its respective housing 49, 51 to adjust the degree to which the dipper door 27 is retarded as it pivots about the axis 33. (It should be apparent from the foregoing that because each arm 31 and plate 37 has a retarding disc 41 compressed therebetween, the pivoting movement of the arms 31 and plates 37 with respect to one another is retarded.)

Figure 5:
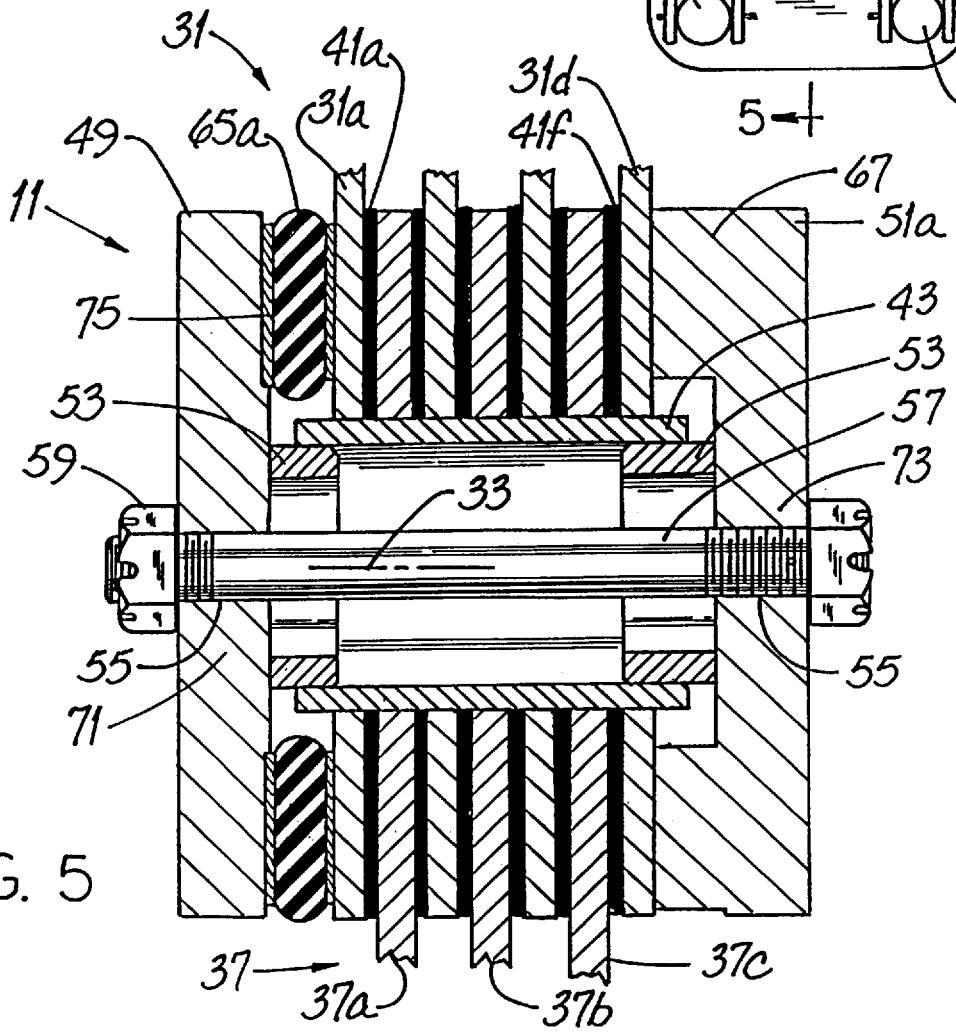
FIG. 5 is a cross-sectional view of one embodiment of the new retarding mechanism taken along the viewing lines 5—5 of FIG. 4. Parts are broken away and other parts are shown in full representation.
Figure 6:
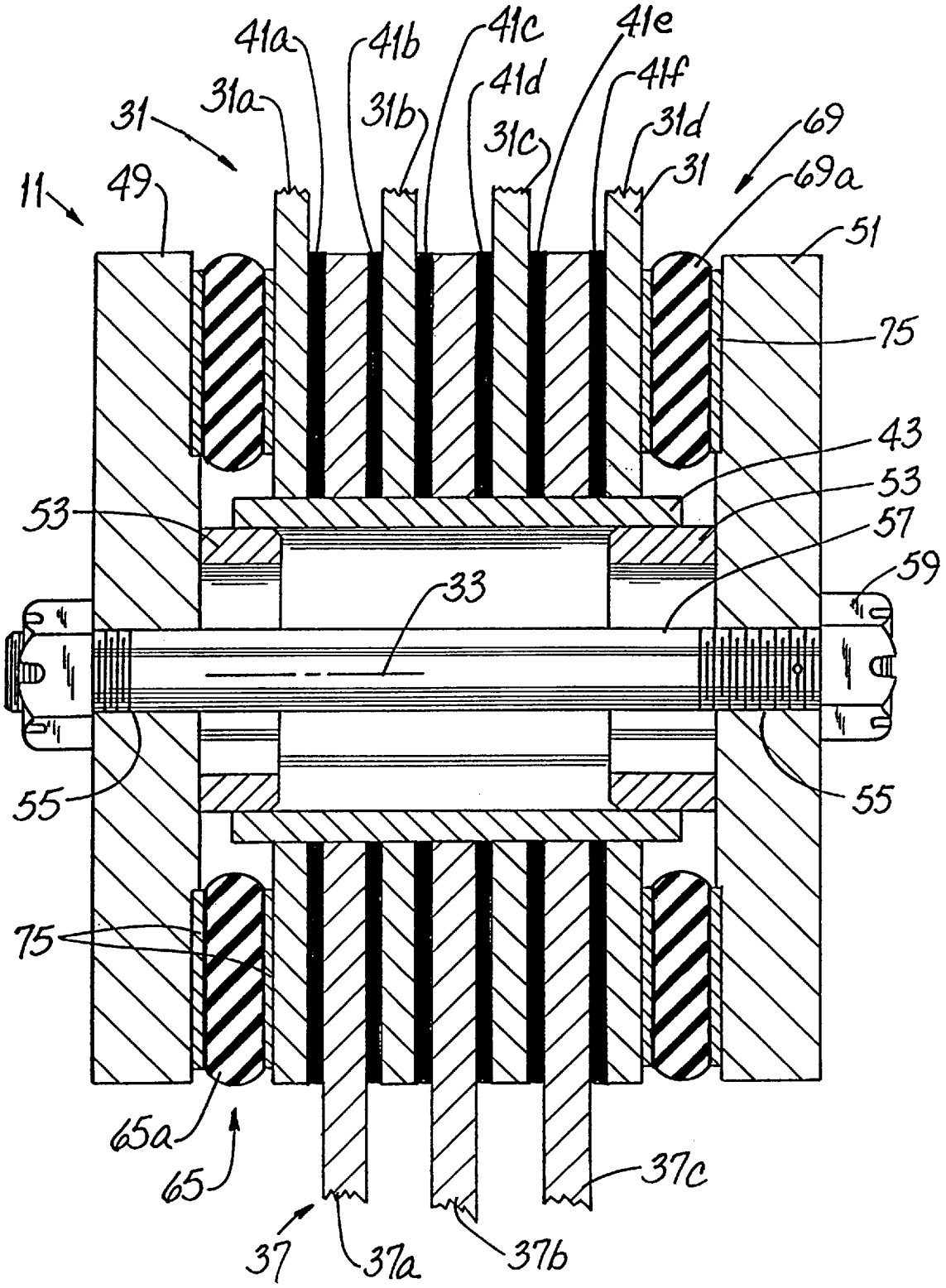
FIG. 6 is a cross-sectional view of the most preferred embodiment of the new retarding mechanism taken along the viewing lines 5—5 of FIG. 4. Parts are broken away and other parts are shown in full representation.

Referring particularly to FIG. 6, a first resilient member 65 is interposed between the first housing 49 and the discs 41. Such member 65 is embodied as an annular ring 65*a* radially outwardly spaced well away from the bolt 57 and from the pivot axis 33. A highly preferred ring 65*a* is made of elastomeric material such as polyurethane. As shown in FIG. 5, if the mechanism 11 includes but a single resilient member, e.g., member 65*a*, the housing 51*a* having no accompanying member 65 is configured with an annular foot piece 67 which bears against the arm 31*d*.

Referring further to FIG. 6, in a highly preferred embodiment, the mechansim 11 further includes a second resilient member 69 interposed between the second housing 51 and the discs 41. Such second member 69 is also preferably embodied as an annular ring 69*a* and is made of elastomeric material such as polyurethane. (In a prior art arrangement, housings resembling the housings 49, 51 have exterior cavities at locations 71 and 73 a spring or stack of Belleville washers is lodged in each cavity between a nut and a housing.) Each ring 65*a*, 69*a* is preferable backed by a pair of annular steel washers 75, one on either annular face of each ring 65*a*, 69*a*.

Figure 9:
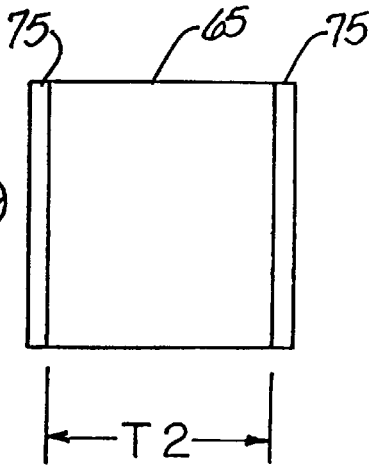
FIG. 9 is a representative view of a resilient member useful with the new retarding mechanism.
Figure 10:
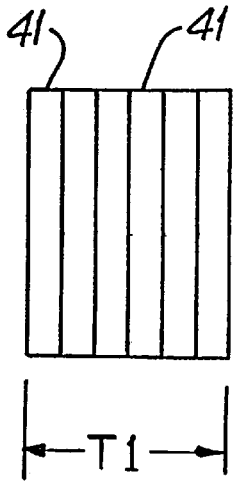
FIG. 10 is a representative view of the retarding discs stacked together for thickness comparison.

The following portion of the specification explains several exemplary embodiments of the new retarding mechanism 11. Referring next to FIGS. 9 and 10, the discs 41 have an aggregate thickness T1 and it is assumed that the mechanism 11 uses but a single resilient member, e.g., member 65. In that instance, the resilient member 65 has a free thickness T2 which is greater than the aggregate thickness T1 of the discs 41. When the mechanism 11 is so configured, the discs 41 may be permitted to become very thin through wear and yet the resilient member 65 maintains compressive force on such discs for retardation.

Figure 11:
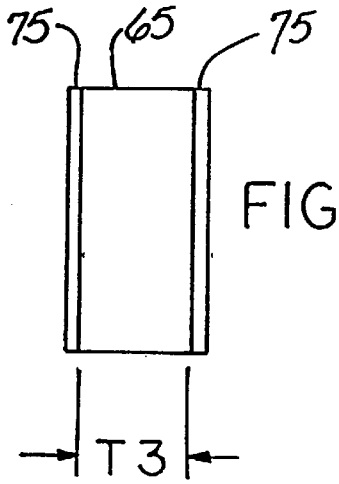
FIG. 11 is a representative view of another resilient member useful with the new retarding mechanism. The resilient members of FIGS. 9 and 11 differ as to thickness.

Referring to FIGS. 10 and 11, the new mechanism 11 is not limited to a single resilient member 65 or 69. Where two resilient members 65, 69 are used, one on each side of the discs 41 as shown in FIG. 6, each resilient member 65, 69 preferably has a free thickness T3 greater than one-half the aggregate thickness T1 of the discs 41.

Figure 12:
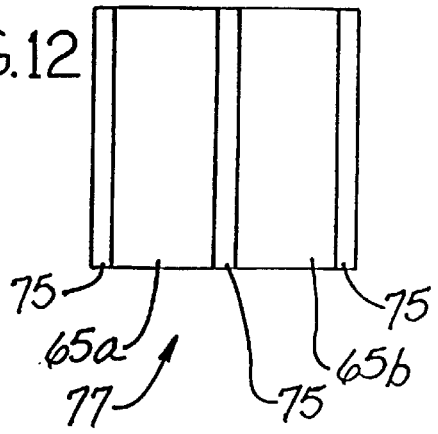
FIGS. 12, 13 and 14 are representative views of different arrangements of resilient assemblies comprising two or more resilient members.
Figure 13:
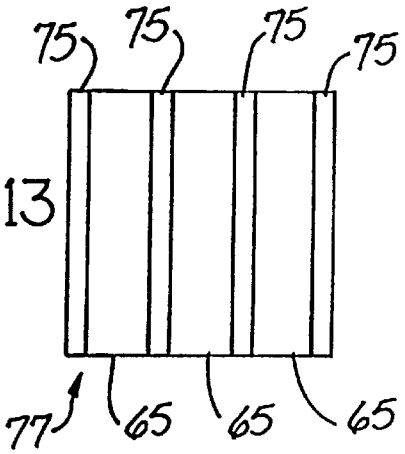

Or the resilient members 65 or 69 may be stacked to form resilient assemblies 77 as shown in FIG. 12 involving two resilient members 65 with steel backup washers 75 and as shown in FIG. 13 involving three resilient members 65 with backup washers 75. The resilient members 65 used in such assemblies 77 (irrespective of whether a single assembly 77 is used with, e.g., the housing 49, or whether two assemblies 77 are used with the housings 49, 51 respectively) are preferably configured to have an aggregate free thickness greater than the aggregate thickness of the discs 41.

Figure 14:
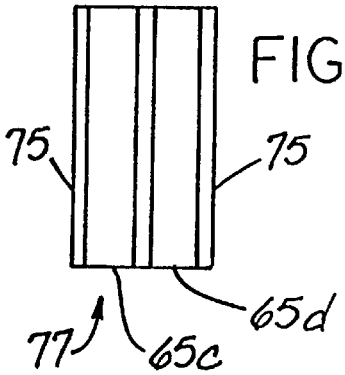

The mechanism 11 may be configured to have first, second and third resilient members compressed between the housings 49, 51. For example, the assembly 77 of FIG. 12 with its first and second resilient members 65*a*, 65*b* (comprising a first plurality of resilient members) may be between the first housing 49 and the first arm 31*a* and the third resilient member 65 such as that shown in FIG. 11 may be between the second housing 51 and the second arm 31*d*. In the alternative, the third resilient member 65 of FIG. 11 may be replaced by the assembly 77 shown in FIG. 14. Such assembly 77 has two resilient members 65*c*, 65*d* forming a second plurality of resilient members.

In summary, it is to be appreciated that the invention offers a good deal of flexibility in its specific configuration. The arrangements described above are but a few of those contemplated by the invention. The mechanism 11 need not have the same number of resilient members 65, 69 on each side nor must the members 65, 69 have the same thickness. However, it is preferred that no matter how many resilient members 65, 69 are used, its free thickness or their aggregate free thickness should exceed the aggregate thickness of the discs 41.

While the principles of the invention have been shown and described in connection with a few specific embodiments, it is to be understood clearly that such embodiments are by way of example and are not limiting.

It is claimed:

1. In a digging implement having a body and movable door mounted with respect to the body and a mechanism for retarding movement of the door, and wherein the mechanism includes first and second housings and plural retarding discs compressed between the housings, the improvement comprising a first resilient member interposed between the first housing and the discs, and a second resilient member interposed between the second housing and the discs.

2. The implement of claim 1 wherein the second resilient member includes an annular ring.

3. The implement of claim 2 wherein:

the discs have an aggregate thickness;

each resilient member has a free thickness greater than one-half the aggregate thickness of the discs.

4. The implement of claim 2 wherein:

the discs have an aggregate thickness;

the resilient members have an aggregate free thickness greater than the aggregate thickness of the discs.

5. The implement of claim 2 wherein:

the mechanism includes a pivot axis and a bolt coincident with the axis; and the annular ring is spaced from the bolt.

6. The implement of claim 5 wherein the annular ring is made of elastomeric material.

7. A mechanism for retarding movement of the door of a mining shovel dipper including:

a plurality of arms extending in a first direction from a pivot axis, such plurality of arms including a first arm and a second arm;

a plurality of plates extending in a second direction from the pivot axis, each plate being between a separate pair of arms;

a separate retarding disc between each plate and each arm, such discs being concentric with the pivot axis;

first and second housings compressing the arms, the plates and the discs; and first and second resilient members compressed between the first and second housings, respectively.

8. The mechanism of claim 7 wherein the resilient members are spaced from the pivot axis.

9. The mechanism of claim 7 wherein the first resilient member is between the first housing and the first arm and the second resilient member is between the second housing and the second arm.

10. The mechanism of claim 7 including first, second and third resilient members compressed between the housings and wherein:

the first and second resilient members are between the first housing and an arm and the third resilient member is between the second housing and the second arm.

11. The mechanism of claim 7 wherein:

the discs have an aggregate thickness; and each resilient member has a free thickness which is greater than one-half the aggregate thickness of the discs.

12. The mechanism of claim 7 wherein:

the discs have an aggregate thickness; and the resilient members have an aggregate free thickness which is greater than the aggregate thickness of the discs.

13. The mechanism of claim 7 including:

a first plurality of resilient members compressed between the first housing and the discs; and a second plurality of resilient members compressed between the second housing and the discs.

* * * * *